US006270181B1

(12) United States Patent
Ota

(10) Patent No.: US 6,270,181 B1
(45) Date of Patent: Aug. 7, 2001

(54) INKJET PRINTER AND METHOD OF PRINTING

(75) Inventor: Takashi Ota, Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/408,435

(22) Filed: Sep. 29, 1999

(30) Foreign Application Priority Data

Sep. 30, 1998 (JP) ..... 10-277581

(51) Int. Cl.[7] ..... B41J 2/01
(52) U.S. Cl. ..... 347/15; 358/298
(58) Field of Search ..... 347/15, 9; 358/298; 346/1.1; 400/120.09

(56) References Cited

U.S. PATENT DOCUMENTS

| | | | | |
|---|---|---|---|---|
| 4,604,654 | * | 8/1986 | Sakurada et al. | 358/298 |
| 4,860,026 | * | 8/1989 | Matsumoto et al. | 346/1.1 |
| 5,142,374 | * | 8/1992 | Tajika et al. | 358/298 |
| 5,795,082 | * | 8/1998 | Shimada et al. | 400/120.09 |
| 5,914,731 | * | 6/1999 | Yono et al. | 347/9 |
| 6,030,065 | * | 2/2000 | Fukuhata | 347/15 |
| 6,079,824 | * | 6/2000 | Gotoh | 347/15 |

FOREIGN PATENT DOCUMENTS

| | | |
|---|---|---|
| 0388978 | 9/1990 | (EP) . |
| 0610096 | 8/1994 | (EP) . |
| 0628415 | 12/1994 | (EP) . |
| 0750995 | 1/1997 | (EP) . |
| 0850767 | 7/1998 | (EP) . |
| 58-39468 | 3/1983 | (JP) . |
| 58-201665 | 11/1983 | (JP) . |
| 59-198162 | 11/1984 | (JP) . |
| 60-151061 | 8/1985 | (JP) . |
| 61-54943 | 3/1986 | (JP) . |
| 4-279359 | 10/1992 | (JP) . |
| 10-128997 | 5/1998 | (JP) . |
| 11-78060 | 3/1999 | (JP) . |
| 8703363 | 6/1987 | (WO) . |

OTHER PUBLICATIONS

European Search Report (in English) issued Jan. 11, 2000 in a related application.

Japanese Office Action issued Nov. 16, 2000 in a related application and English translation of relevant portions.

* cited by examiner

*Primary Examiner*—J E Barlow
*Assistant Examiner*—Craig A. Hallacher
(74) *Attorney, Agent, or Firm*—Ostrolenk, Faber, Gerb & Soffen, LLP

(57) ABSTRACT

Disclosed herein is an inkjet printer (11) in which printing can be conducted with a normal ink and a light ink each having a plurality of ink droplet sizes to generate high quality pictures. When the number of the sizes is three, the 7 level gray scale printing can be performed because the three different densities for the respective two links and another density in which no dot is printed are utilized. Further disclosed is a printing method employing the inkjet printer (11).

15 Claims, 13 Drawing Sheets

SMALL DROPLET

MEDIUM DROPLET

LARGE DROPLET

SMALL DROPLET

MEDIUM DROPLET

LARGE DROPLET

NO DOT

INKJET PRINTER AND METHOD OF PRINTING

BACKGROUND OF THE INVENTION (a) Field of the Invention

The present invention relates to an inkjet printer and method of printing, and more in detail to the inkjet printer and the method of printing in which high quality printing can be conducted by increasing the number of gray scales of printing density.

(b) Description of the Related Art

A non-impact recording method which is excellent in its negligibly small noise at printing is attracting public interest. An inkjet recording technology included in the non-impact recording method enables high speed recording on a recording medium in a simple mechanism and conveniently employs an ordinary plain paper as the recording medium.

The inkjet recording systems are roughly categorized into a continuous jet system and an on-demand system (impulse system). Since the on-demand system is driven depending on a necessity to eject ink droplets, ink consumption is moderate. The structure thereof is also extremely simple. Accordingly, wide spread of the on-demand system is expected.

A conventional inkjet printer using the on-demand system is described in JP-A-59(1984)-198162, JP-A-58(1983)-39468 etc. in which the following examples are mentioned. A first conventional example is such that dots are printed after they are converted into a specified matrix size for conducting medium tone recording (dither method). A second conventional example includes a plurality of ink chambers accommodating inks having different densities, a plurality of nozzles for each of the ink chambers and a plurality of dot forming section corresponding to at least two inks of the same color having different densities. In the latter printer, gray scale level of a pixel formed as a matrix is generated by changing the number of ink particles supplied into the matrix and the density of the ink particles in accordance with a gray scale signal. A third example is such that the size of ejected ink droplets is changed by modifying conditions of a driving pulse of a piezoelectric device.

Ordinarily, in order to conduct full-color printing (16.77 million colors), 256 gray scale of 256 levels for each color of Y (yellow), M (magenta) and C (cyan) are required. When the gray scale of 256 levels per dot is realized in a specific area of for example, 600 dots×800 dots of a CRT screen, the amount of information reaches to 600 dots×800 dots×3 bite=1.44 MB because the 256 levels are expressed as 1 bite ($=2^8$).

In this text, an ink having a higher density is defined as "normal ink" and an ink having a lower density is defined as "light ink". A binary level in which a dot of the normal ink having a specified dot size is implemented by "printed" or "not printed" in the first conventional example. The amount of information in this case reaches only to 11.25 kB (600 dots×800 dots×3×2 (binary value)/256). In order to output the 256 levels, a dither matrix of 16 dots×16 dots(=256) is necessary.

A ternary level in which a dot of the normal ink having a specified dot size is "printed", or a dot of the light ink having a specified dot size is "printed" or none of the inks are "printed" is utilized in the second conventional example. Assuming that a relative printing density of the normal ink is defined as "1", that of the light ink is defined as "½" and that of a printing paper is defined as "0" in the second conventional example, the amount of information reaches to 600 dots×800 dots×3×3(ternary value)/256=16.875 kB. When the light ink takes charge of 128 levels from 0 to 127 and the normal ink takes charge of 128 levels from 128 to 255, a dither matrix of 12 dots×12 dots (≈128) is necessary to output 256 levels.

In the third conventional example, a 4 level gray scale is utilized in which a dot size of an ink is variable and a large droplet is "printed", a medium droplet is "printed", a small droplet is "printed" and none of the droplets are "printed". Assuming that a relative printing density of the normal ink having the large droplet is defined as "1", that having the medium droplet is defined as "⅔", that having the small droplet is defined as "⅓" and that having none of the droplets is defined as "0" in the third conventional example, the amount of information reaches to 600 dots×800 dots×3×(four-value)/ 256=22.5 kB. Assuming that the small droplet takes charge of 86 levels from 0 to 85, the medium droplet takes charge of 85 levels from 86 to 170 and the large droplet takes charge of 85 levels from 171 to 255, a dither matrix of 9 dots×9 dots (≈85) is necessary to output 256 levels.

In the first conventional example, a matrix of 256 dots or "16×16" is required to output 256 levels, and the amount of information with respect to all the gray scale levels is as small as to 11.25 kB. In the binary level employing only the relative densities "0" and "1", coarseness of the image quality appears in a highlighted area to generate a low quality picture.

Although, in the second conventional example, the amount of information with respect to all the inks is 16.875 kB, the quality of the picture which is elevated 1.5 times that of the first example is not yet satisfactory. In the ternary level employing the relative densities "0", "0.5" and "1", the coarseness of the quality as well although the image quality is somewhat improved over the first example.

In the third conventional example, a limit of the variable range of the dot size exists wherein the small dot is difficult to print, and only the relative printing densities "0" (no dots are printed) and "about 0.3 to 1" can be realized. Although the region between 0.3 and 1 may be more finely divided in principle, this division has little influence on the improvement of the picture quality, and the division of the range may be at the most three levels. Accordingly, the 4 level gray scale per dot is appropriate as described herein, the amount of information increases to 22.5 kB, and a dither matrix required for outputting a 256 level gray scale is reduced to 9×9 dots (≈85). Although the picture quality of the third example is better that those of the first and the second examples, it is not satisfactory. The coarseness of the picture is still noticeable because the limit of the variable range of the dot size exists and the small dot cannot be printed.

An approach for improving the picture quality such as multi-level processing and improvement of resolution (dpi: dot per inch) is known, but the present inventor intends to obtain a higher quality picture by employing further high multi-level processing to make the present invention based on an original idea.

SUMMARY OF THE INVENTION

In view of the foregoing, an object of the present invention is to provide an inkjet printer which realizes pictures having a high definition and a method of printing.

The present invention is provides, in a first aspect thereof, an inkjet printer including: a first ink ejector capable of ejecting a normal ink at a plurality of sizes for printing; a second ink ejector capable of ejecting a light ink at a plurality of sizes for printing, the light ink having a density is lower than a density of the normal ink; a density judgment section for analyzing input printing data to judge whether a printing region has a first density or a second density; and a print control section which controls the first ink ejector to print when the density judgment section judges that the printing region has first density, and the second ink ejector to print when the density judgment section judges that the printing region has the second density.

The second aspect of the present invention is directed to an inkjet printer including: a first ink ejector capable of ejecting a normal ink at a plurality of sizes for printing; a second ink ejector capable of ejecting a light ink at a plurality of sizes for printing, the light ink having a density lower than a density of the normal ink; a density judgment section for analyzing input printing data to specify a gray scale level in a printing region in which densities in input printing data corresponding to the printing regions are different from one another; and a print control section for driving, based on the gray scale level specified by the density judgment section, individually or simultaneously the first ink ejector and the second ink ejector.

The third aspect of the present invention is directed to a printing method comprising the steps of: analyzing input printing data; judging whether a printing region has a first density or a second density lower than the first density; and printing the printing region with a normal ink when the corresponding printing region is judged to have the first density or with a light ink of which a density is lower than that of the normal ink when the corresponding printing region is judged to have the second density.

The fourth aspect of the present invention is directed to a printing method comprising the steps of: judging each of printing regions to have a specified density among a plurality of densities from input printing data; and conducting the printing, based on the above judgment, with ink droplets of normal ink and a light ink having a plurality of sizes individually ejected or superimposed.

In accordance with the inkjet printer of the first aspect of the present invention, a 7 level gray scale printing can be achieved, for example, in the relative density of the ink between 0 and 1 by means of variation of the dot area rate.

The plurality of sizes preferably correspond to a small droplet, a medium droplet and a large droplet. The 7 level gray scale printing can conduct a higher definition printing to generate high quality pictures.

In accordance with the inkjet printer of the second aspect of the present invention, the 11 level or more can be realized from the relative densities of dots of the light ink and the normal ink to conduct a higher definition printing to generate higher quality pictures.

In accordance with the printing methods of the third and the fourth aspects of the present invention, a 9 and an 11 level gray scale printing can be similarly realized to generate similar affects.

The above and other objects, features and advantages of the present invention will be more apparent from the following description.

REFERRED EMBODIMENTS OF THE INVENTION

Now, the present invention is more specifically described with reference to accompanying drawings.

Embodiment 1

Figure 1:
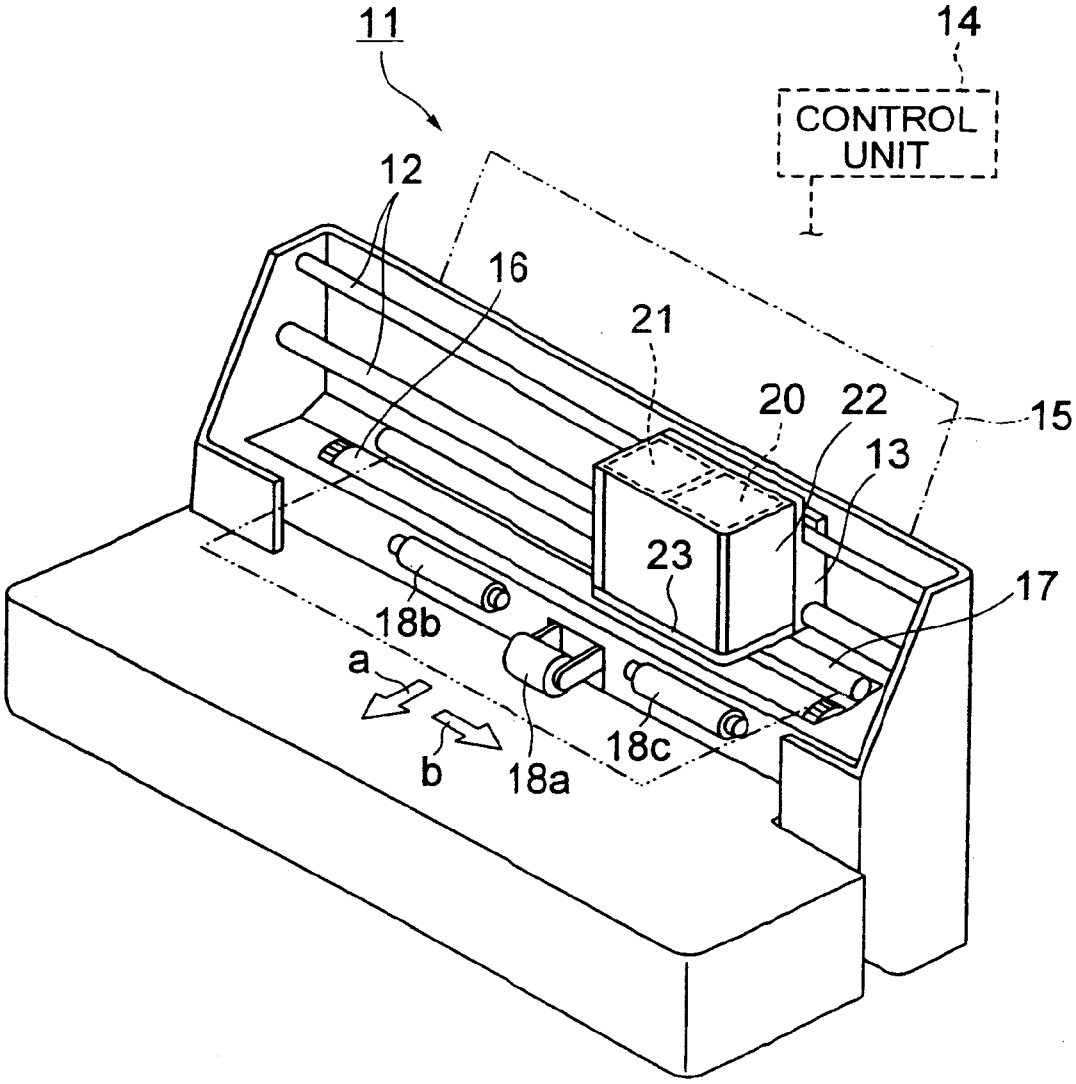
FIG. 1 is a perspective view showing an entire configuration of an inkjet printer in accordance with Embodiment 1 of the present invention.

As shown in FIG. 1, an inkjet printer 11 includes guiding axes 12 extending in a horizontal direction of the upper space of the printer 11, a head carriage 13 moving reciprocally along the guiding axes 12 by means of power of a motor (not shown) and a control unit 14 supervising various operations. The printer 11 has a pair of supply rollers 16 and 17 for supplying a recording paper 15 which is, at the time of printing, intermittently supplied by a specified length in a direction of an arrow "a" by means of the supply rollers 16 and 17 linked with the operation of the head carriage 13.

Discharge rollers 18*a*, 18*b* and 18*c* are located for supporting the reverse surface of the recording paper 15 on a conveying path in front of the supply rollers 16 and 17. The head carriage 13 has a holder 22 accommodating a normal ink cartridge 20 and a light ink cartridge 21, and a recording head 23 for ejecting ink droplets on the recording paper 15. The normal ink has a higher content ratio of a color ingredient therein and the light ink has a lower content ratio of the color ingredient therein.

Figure 2:
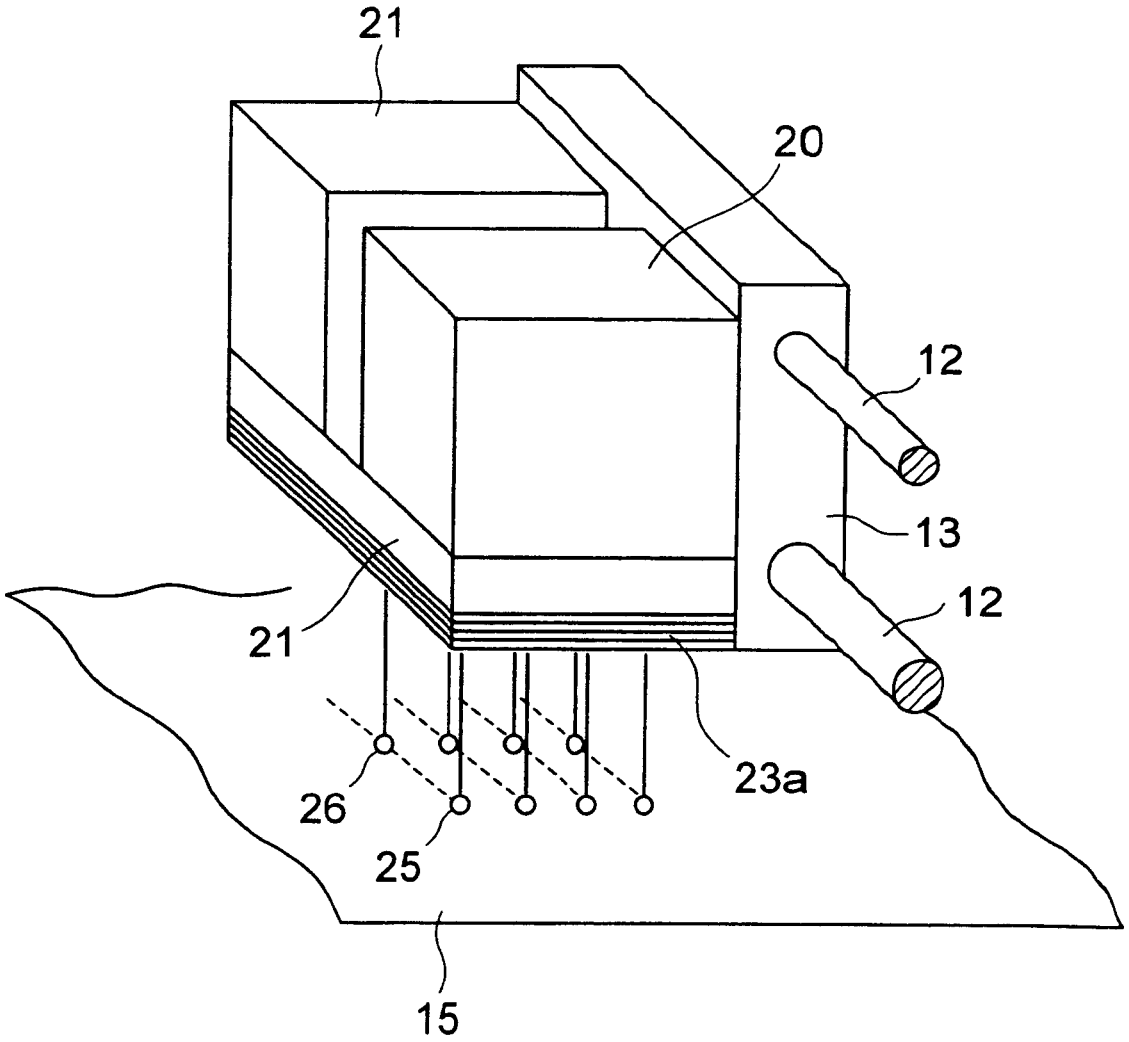
FIG. 2 is an enlarged perspective view showing a recording head of the inkjet printer.

The recording head 23 shown in FIG. 2 in which the holder is omitted has a head 23*a* at a lower portion thereof including nozzles for ejecting ink droplets. Normal links for yellow (Y), magenta (M) and cyan (C) are accommodated in the normal ink cartridge 20 separated from one another, and light inks for yellow (Y), magenta (M) and cyan (C) are accommodated in the light ink cartridge 21 and separated from one another.

Each of the color inks supplied from the light ink cartridge 21 reaches to a pressure chamber by way of an ink pool corresponding to each color and fills the pressure chamber.

When ejection energy from a piezoelectric device is applied, ink droplets for each color are ejected onto the recording paper 15 through the respective nozzles formed in the pressure chamber corresponding to the respective piezoelectric devices to perform the printing. FIG. 2, there are illustrated a group of ink droplets 25 ejected from the nozzles corresponding to the respective color inks in the normal ink cartridge 20 to the recording paper 15 and a group of ink droplets 26 ejected from the nozzles corresponding to the respective color inks in the light ink cartridge 21 to the recording paper 15.

Figure 3:
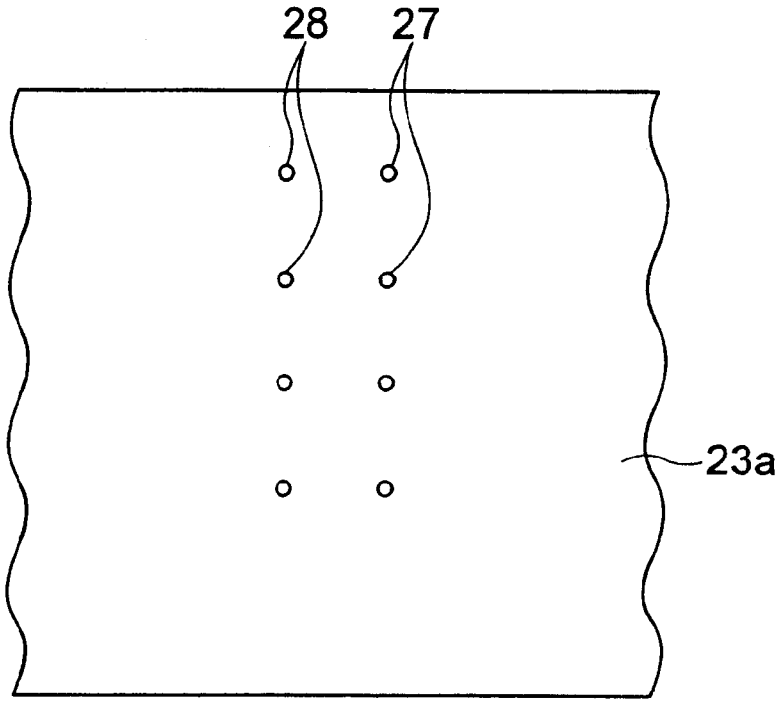
FIG. 3 is a bottom view showing a part of the recording head.

Normal ink nozzles 27 for ejecting the normal ink droplets 25 and light ink nozzles 28 for ejecting the light ink droplets 26 are formed on the bottom surface of the head 23*a* as shown in FIG. 3.

Figure 4:
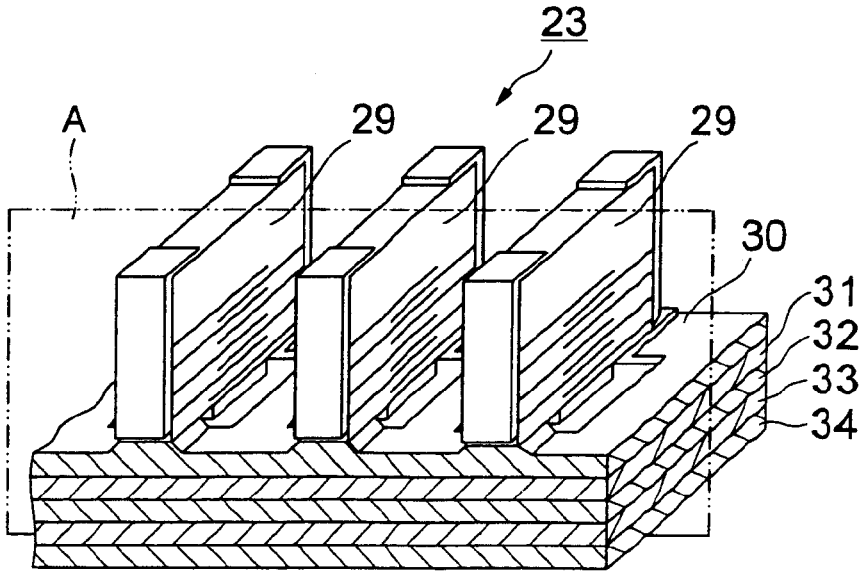
FIG. 4 is a perspective view of a part of the recording head.

The recording head 23 shown in FIG. 4 has piezoelectric devices 29 including a plurality of separate electrodes the number of which is the same as that of the corresponding nozzles and a common electrode opposing to all the separate electrodes. The recording head 23 further includes, from top to bottom, a vibration plate 30, a pressure plate 31, a supply plate 32, a pool plate 33 having a perforation aperture functioning as an ink pool, and an ejection plate 34 having nozzles.

Figure 5:
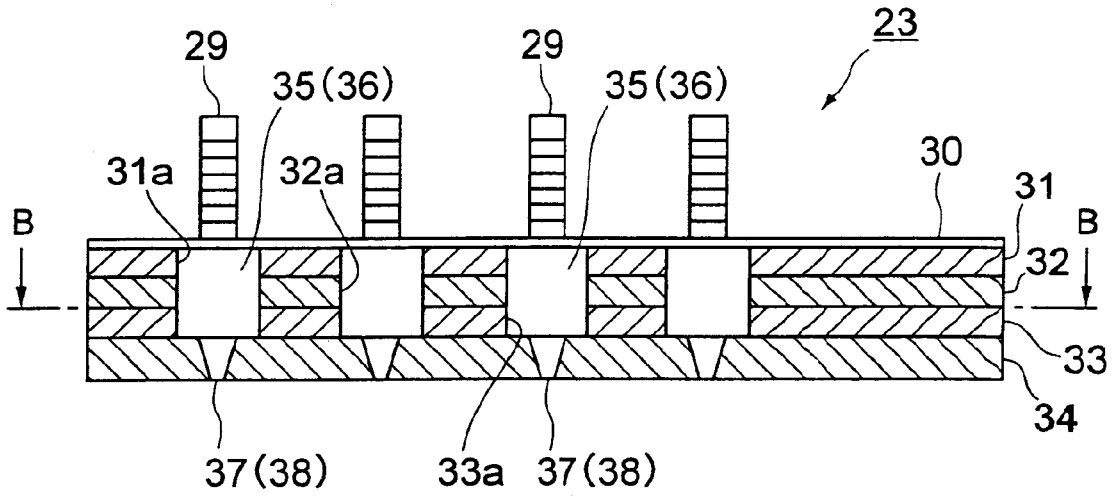
FIG. 5 is a vertical cross sectional view of the recording head taken along a plane A in FIG. 4.

As shown in FIG. 5, penetration apertures 31*a*, 32*a* and 33*a* are formed in the pressure plate 31, the supply plate 32 and the pool plate 33 bonded with one other for forming normal ink pressure chambers 35 and light ink pressure chambers 36. The ejection plate 34 has normal ink nozzles 37 and light ink nozzles 38 at positions corresponding to the normal ink pressure chambers 35 and the light ink pressure chambers 36, respectively.

Figure 6:
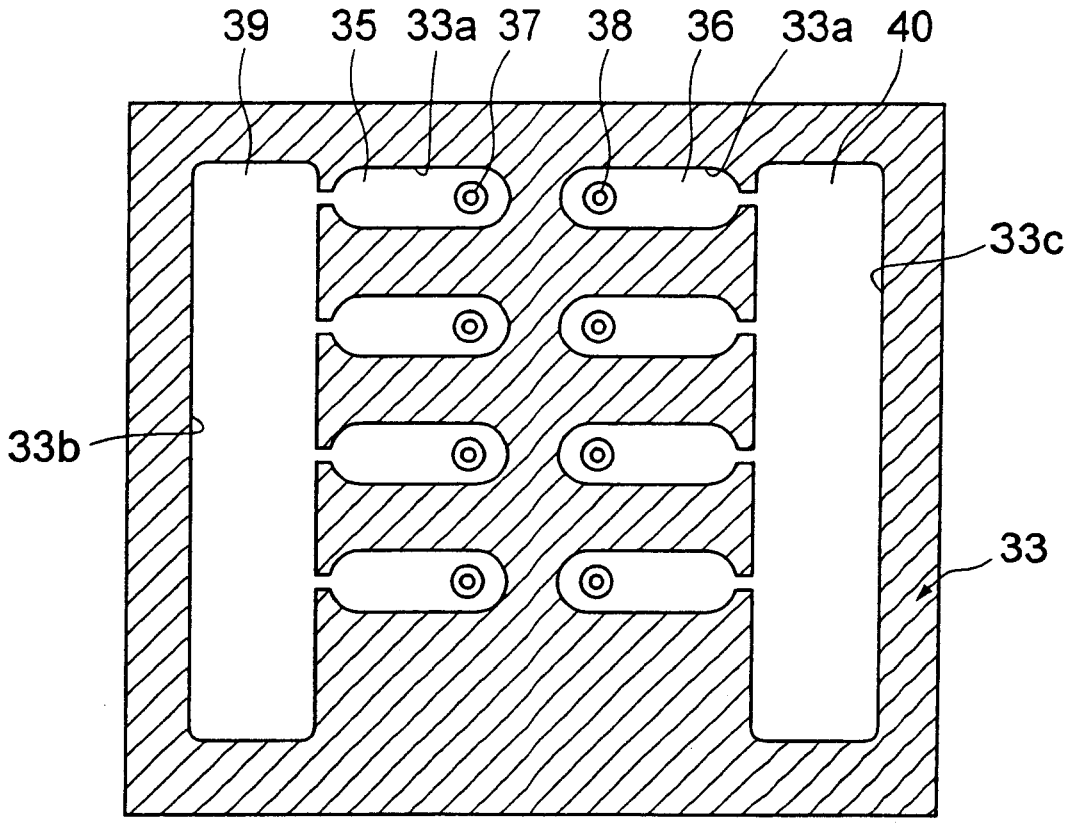
FIG. 6 is a horizontal cross sectional view of the recording head taken along a line B—B in FIG. 5.

The pool plate 33 as shown in FIG. 6 has the penetration apertures 33*a* constituting parts of the normal ink pressure chambers 35 and the light ink pressure chambers 36 in correspondence with the rows of the normal ink nozzles 37 and the light ink nozzles 38 formed in the ejection plate 34, respectively. A penetration aperture 33*b* constituting part of a normal ink pool 39 which connects the four normal ink pressure chambers 35 and a penetration aperture 33*c* constituting part of an light ink pool 40 which connects the four light ink pressure chambers 35 at symmetrical positions of the pool plate 33 are formed.

Figure 7:
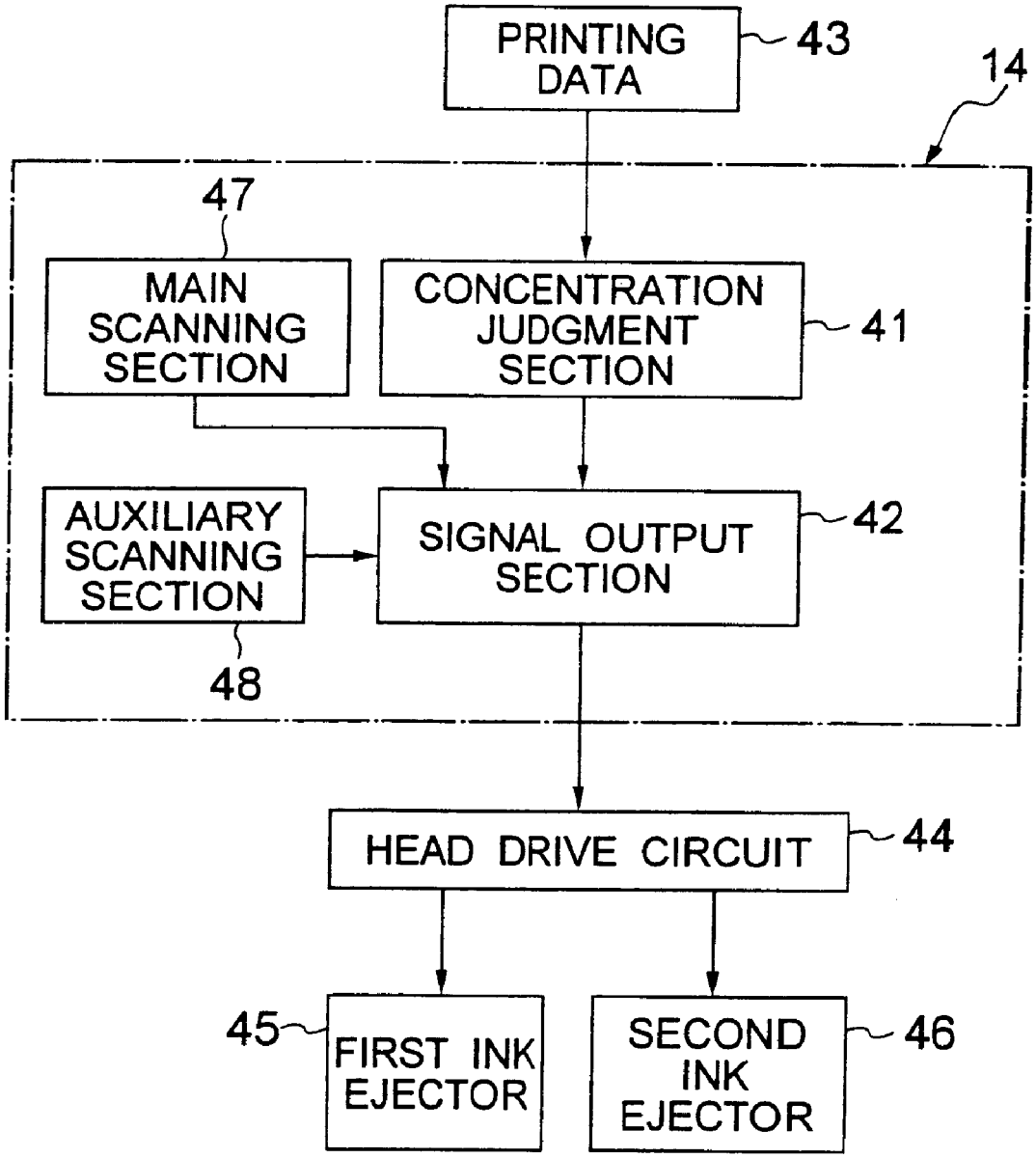
FIG. 7 is a block diagram showing a configuration of a controlling part of the inkjet printer of Embodiment 1.

As shown in FIG. 7, the control unit 14 of Embodiment 1 has a density judgment section 41, a signal output section 42, a main scanning section 47 and an auxiliary scanning section 48. Printing data 43 are input to the control unit 14 and a signal is output to a head drive circuit 44. A first ink ejector 45 and a second ink ejector 46 are connected to the head drive circuit 44.

The density judgment section 41 analyzes the input printing data 43 and judges whether a density of a printing region has a first density or a second density lower than the first density.

The signal output section 42 outputs to the head drive circuit 44 a first signal which orders the printing with the normal ink after the dot size is changed by means of the first ink ejector 45 when the printing region is judged to have the first density by means of the density judgment section 41. The signal output section 42 further outputs to the head drive circuit 44 a second signal which directs the printing with the light ink after the dot size is changed by means of the second ink ejector 46 when the printing region is judged to have the second density by means of the density judgment section 41. The first and the second signals include a signal which instructs that no ink droplets be ejected from both of the first and the second ink ejectors 45 and 46.

The main scanning section 47 directs a timing of driving the piezoelectric device (a timing of ejecting the ink) to the signal output section 42 is synchrony with the movement of the head carriage 13 in a main scanning direction (a direction of an arrow "b" of FIG. 1). The auxiliary scanning section 48 generates a timing for driving which controls travel of the recording paper 15 in an auxiliary scanning direction (a direction of an arrow "a" of FIG. 1).

The head drive circuit 44 drives piezoelectric device 29 by supplying power to the corresponding separate electrode in accordance with the first or the second signal from the signal output section 42 to perform the printing. The signal output section 42 and the head drive circuit 44 constitute a print control section.

The first ink ejector 45 exists on the normal ink side of the recording head 23 and enables the ejection of the normal ink in the normal ink pool 39 through the normal ink nozzles 37 at a plurality of sizes. The second ink ejector 46 exists on the light ink side of the recording head 23 and enables the ejection of the light ink in the light ink pool 40 through the light ink nozzles 38 at a plurality of sizes.

Accordingly, the signal output section 42 has ternary level data which eject a small droplet, a medium droplet and a large droplet of the normal ink by means of the first ink ejector 45, another ternary level data which eject a small droplet, a medium droplet and a large droplet of the light ink by means of the second ink ejector 46, and a single level data which ejects no ink droplets from the first and the second ink ejectors 45 and 46, thereby achieving a 7 level gray scale in connection with a relative density by changing a dot area rate. The dot area rate as well herein means a ratio of a dot area to a lattice area under the standard resolution.

In this manner, the inkjet printer having the above configuration conducts the printing with the normal ink by means of changing the dot size when the density judgment section 41 judges the printing region to have the first density based on the input printing data 43, and conducts the printing with the light ink by means of changing the dot size when the density judgment section 41 judges the printing region to have the second density.

Figure 8A:
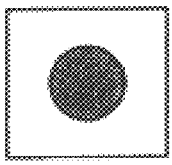
FIGS. 8A to 8G show each of dots printed by the inkjet printer of Embodiment 1.
Figure 8B:
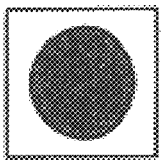
Figure 8C:
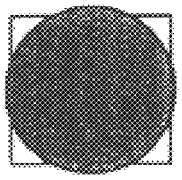
Figure 8D:
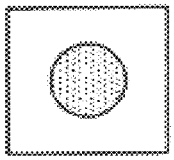
Figure 8E:
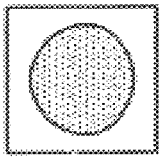
Figure 8F:
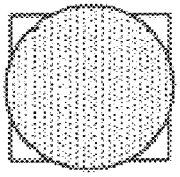
Figure 8G:
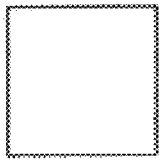

FIGS. 8A to 8G show the respective dots printed by the inkjet printer. FIGS. 8A to 8C show small droplet, a medium droplet and a large droplet of a normal ink, FIGS. 8D to 8F show small droplet, a medium droplet and a large droplet of a light ink and FIG. 8G shows a picture on which no dots are printed.

In the present Embodiment, the picture quality obtained as a result of the printing can be improved by employing the 7 level gray scale including a case in which one or more of the small droplet, the medium droplet and the large droplet of the normal ink are ejected, a case in which one or more of the small droplet, the medium droplet and the large of the light ink are ejected and a case in which no dots are printed.

Assuming that the relative density of the large droplet of the normal ink is 1 and the dot area rates of the small droplet, the medium droplet and the large droplet of the normal ink are 1:0.75:0.5, the relative densities thereof are 1(6/6):0.75 (4.5/6):0.5(3/6) and the inputs thereof are 6:5:4. Further assuming that the relative density of the large droplet of the light ink is 0.3 and the dot area rates of the small droplet, the medium droplet and the large droplet of the normal ink are 1:0.75:0.5, the relative densities thereof are 0.3(1.8/6):0.225 (1.35/6):0.15(0.9/6) and the inputs thereof are 3:2:1. In the FIG. 8G, the dot area rate is 0, the relative density is 0 and the input is 0 when no dots are printed. The relative density is calculated by multiplying the dot area rate by ink relative density.

In Embodiment 1, in order to output, for example, 256 level gray scale, a matrix of 7×7 which is calculated by the following equation is sufficient for obtaining pictures of high definition.

$$<256/(7-1)>^{1/2}=(42.7)^{1/2}\approx 6.53$$

The amount of information reaches to 600 dots×800 dots×3×7−value/256=39.375 kB which is 1.75 times that of the third conventional example to provide high precision pictures.

Figure 9:
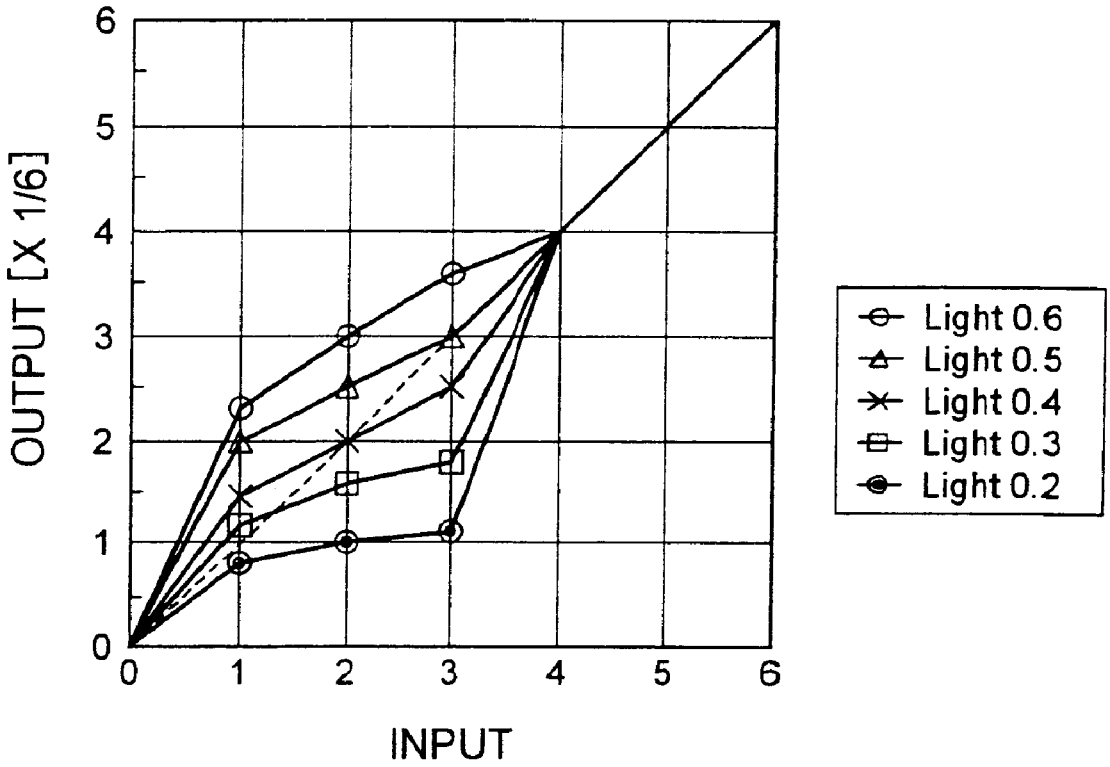
FIG. 9 is a graph showing a relation between an input and an output when a printing region having a first density is printed with a normal ink and another printing region having a second density is printed with a light ink.

Relations between an input and an output are shown in FIG. 9 when the density judgment section 41 judges the printing region to have the first density to conduct the printing with normal ink and when the density judgment section 41 judges the printing region to have the second density to conduct the printing with the light ink. In the graph, ○, Δ, x, □ and ⊙ indicate outputs obtained by the 7 level gray scale inputs when the printing densities of the light ink are 0.6, 0.5, 0.4, 0.3 and 0.2, respectively. The dot area rates of the normal ink and the light ink in this example are shown in Table 1.

TABLE 1

| | | | | | | |
|---|---|---|---|---|---|---|
| Dot | Large Droplet | 1 | 1 | 1 | 1 | 1 |
| Area | Medium Droplet | 0.83 | 0.83 | 0.83 | 0.83 | 0.83 |
| Rate | Small Droplet | 0.67 | 0.67 | 0.67 | 0.67 | 0.67 |

The printing densities of the normal ink and the light ink in the graph are shown in Table 2.

TABLE 2

| | | | | | |
|---|---|---|---|---|---|
| Normal Ink Density | 1 | 1 | 1 | 1 | 1 |
| Light Ink Density | 0.6 | 0.5 | 0.4 | 0.3 | 0.2 |

Relations between the inputs and the outputs of every printing density of the light ink are shown in Table 3.

TABLE 3

| | Output | | | | |
|---|---|---|---|---|---|
| Input | Light 0.6 | Light 0.5 | Light 0.4 | Light 0.3 | Light 0.2 |
| 0 | 0 | 0 | 0 | 0 | 0 |
| 1 | 0.4 | 0.33 | 0.27 | 0.2 | 0.13 |
| 2 | 0.5 | 0.42 | 0.33 | 0.25 | 0.17 |
| 3 | 0.6 | 0.5 | 0 | 0.3 | 0.2 |
| 4 | 0.67 | 0.67 | 0.67 | 0.67 | 0.67 |
| 5 | 0.83 | 0.83 | 0.83 | 0.83 | 0.83 |
| 6 | 1 | 1 | 1 | 1 | 1 |

When the dot area rates of the large droplet, the medium droplet and the small droplet are 1, 0.83 and 0.67, respectively in this example, the light ink printing density can be varied in a range between 0.2 and 0.6, and the light ink printing density is preferably between 0.3 and 0.5 because it is approximated by an ideal variation line indicated by a broken line in the graph.

Figure 10:
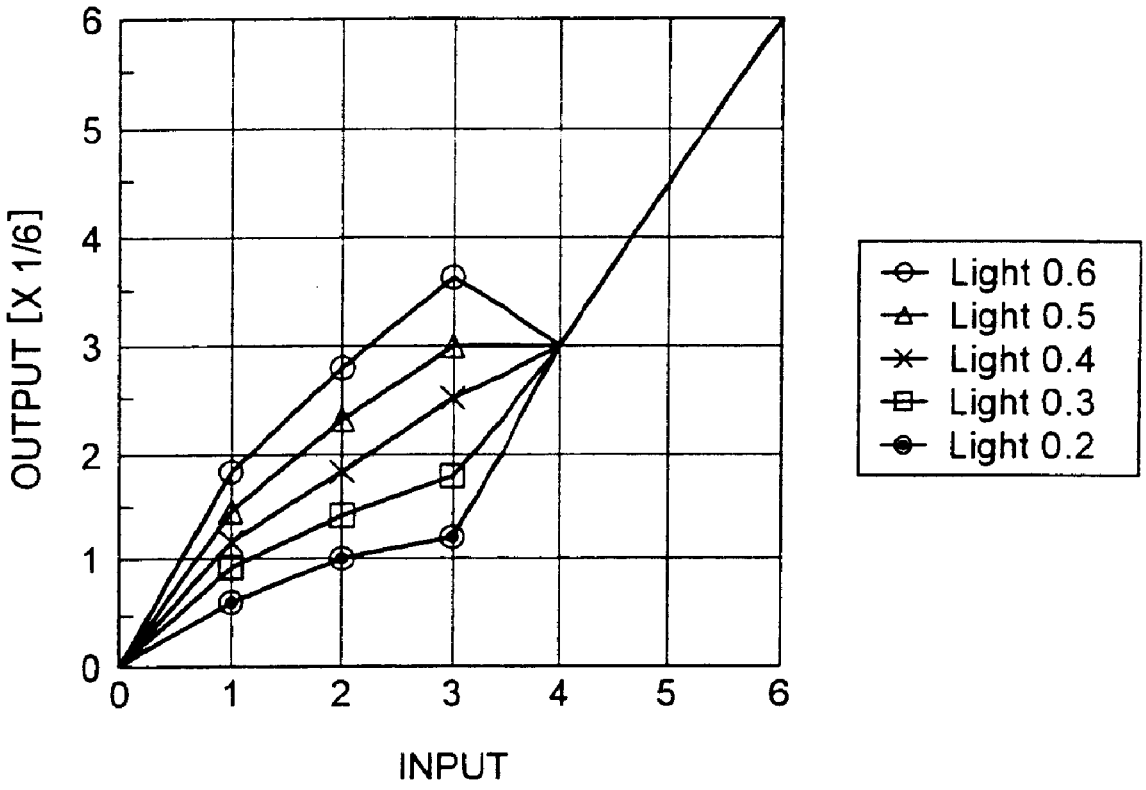
FIG. 10 is a graph showing a relation between an input and an output when a dot area rate is changed.

Relations between an input and an output are shown in a graph of FIG. 10 when the dot area rates of FIG. 9 are varied. In the graph, ○, Δ, X, □ and ⊙ indicate outputs obtained by the 7 level gray scale inputs when the printing densities of the light ink are 0.6, 0.5, 0.4, 0.3 and 0.2, respectively. The dot area rates of the normal ink and the light ink in this example are shown in Table 4.

TABLE 4

| | | | | | | |
|---|---|---|---|---|---|---|
| Dot | Large Droplet | 1 | 1 | 1 | 1 | 1 |
| Area | Medium Droplet | 0.75 | 0.75 | 0.75 | 0.75 | 0.75 |
| Rate | Small Droplet | 0.5 | 0.5 | 0.5 | 0.5 | 0.5 |

The printing densities of the normal ink and the light ink in the graph are shown in Table 5.

TABLE 5

| | | | | | |
|---|---|---|---|---|---|
| Normal Ink Density | 1 | 1 | 1 | 1 | 1 |
| Light Ink Density | 0.6 | 0.5 | 0.4 | 0.3 | 0.2 |

TABLE 6

| | Output | | | | |
|---|---|---|---|---|---|
| Input | Light 0.6 | Light 0.5 | Light 0.4 | Light 0.3 | Light 0.2 |
| 0 | 0 | 0 | 0 | 0 | 0 |
| 1 | 0.3 | 0.25 | 0.2 | 0.15 | 0.1 |
| 2 | 0.45 | 0.375 | 0.3 | 0.225 | 0.15 |
| 3 | 0.6 | 0.5 | 0.4 | 0.3 | 0.2 |
| 4 | 0.5 | 0.5 | 0.5 | 0.5 | 0.5 |
| 5 | 0.75 | 0.75 | 0.75 | 0.75 | 0.75 |
| 6 | 1 | 1 | 1 | 1 | 1 |

Relations between the inputs and the outputs of every printing density of the light ink are shown in Table 6.

When the dot area rates of the large droplet, the medium droplet and the small droplet are 1, 0.75 and 0.5, respectively in this example, the light ink printing density can be varied in a range between 0.2 and 0.6, and the light ink printing density is preferably between 0.2 and 0.4 because it is approximated by an ideal variation line (not shown in the graph).

Figure 11:
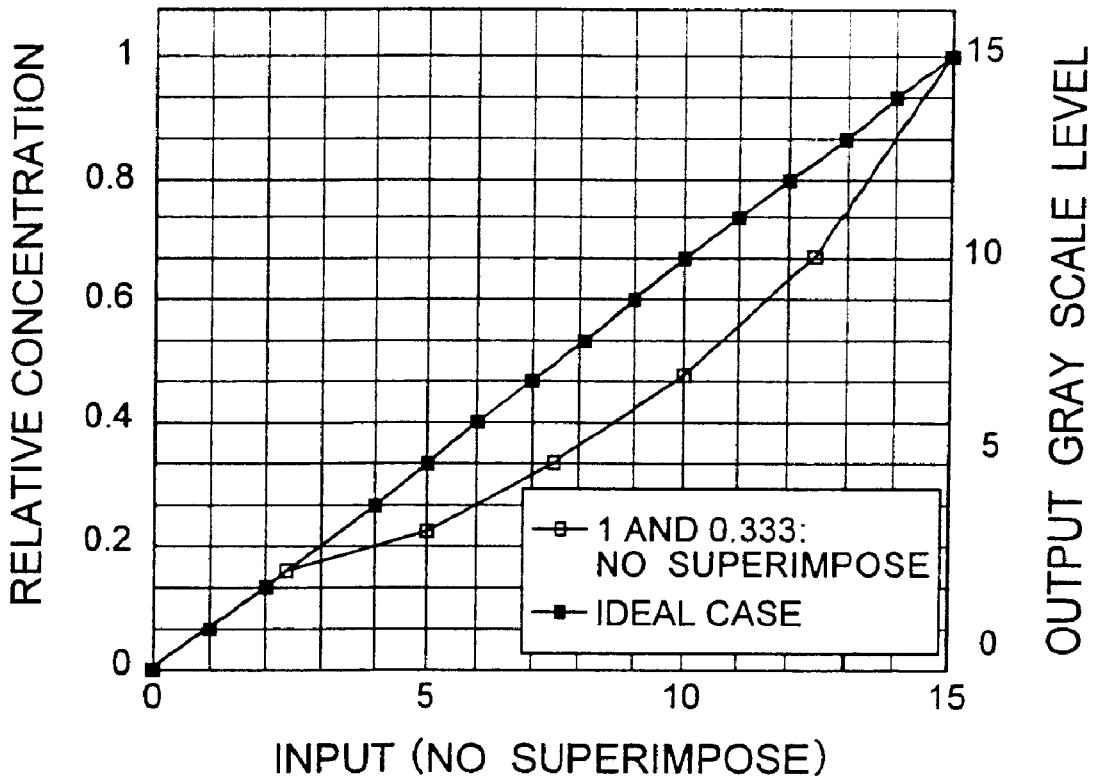
FIG. 11 is a graph showing data when each of dots of the normal ink and the light ink are printed without superimposing in a different style from those of FIGS. 9 and 10.

FIG. 11 is a graph showing data differently from FIGS. 9 and 10 when the printing is conducted while the respective dots of the normal ink and the light ink are not superimposed. In this graph, the horizontal axis indicates an input and the vertical axis indicates a relative density and an output gray scale level. In this example, variation of the relative density and the output gray scale level when the relative densities of the normal ink and the light ink are made to be 1 and 0.333 without superimpose was indicated with □, and variation in an ideal case was indicated with ■.

The variation of values of no superimpose is shown in Table 7 in which the dot area rates of the normal ink and the light ink are 1, 0.67 and 0.48 for a large droplet, a medium droplet and a small droplet, respectively. In Table 7, "L" means "light ink" and "N" means "normal ink.

TABLE 7

| 1 and 0.333: no superimpose | | | | | |
|---|---|---|---|---|---|
| horizontal axis | gray scale level | ideal | ink relative density | dot area rate | relative density |
| 0 | 0 | 0 | 0 | 0 | 0 |
| 2.5 | 1 | 0.167 | 0.333 (L) | 0.48 | 0.16 |
| 5 | 2 | 0.333 | 0.333 (L) | 0.67 | 0.22 |
| 7.5 | 3 | 0.5 | 0.333 (L) | 1 | 0.33 |

TABLE 7-continued

| 1 and 0.333: no superimpose | | | | | |
|---|---|---|---|---|---|
| hori-zontal axis | gray scale level | ideal | ink relative density | dot area rate | relative density |
| 10 | 4 | 0.667 | 1 (N) | 0.48 | 0.48 |
| 12.5 | 5 | 0.833 | 1 (N) | 0.67 | 0.67 |
| 15 | 6 | 1 | 1 (N) | 1 | 1 |

A ratio of the printing density of the light ink to that of the normal ink ranges between 0.2 and 0.5 in Embodiment 1. The dot area rates of both of the light ink and the normal ink vary in a range between 0.4 and 0.9. The 7 level gray scale can be realized in the relative density between 0 and 1 variation of the dot area rate.

Embodiment 2

Printing of the Embodiment 2 can be conducted employing the normal ink and the light ink in which are superimposed with each other on the same position at a dot pitch of standard resolution and have variable dot sizes.

Figure 12:
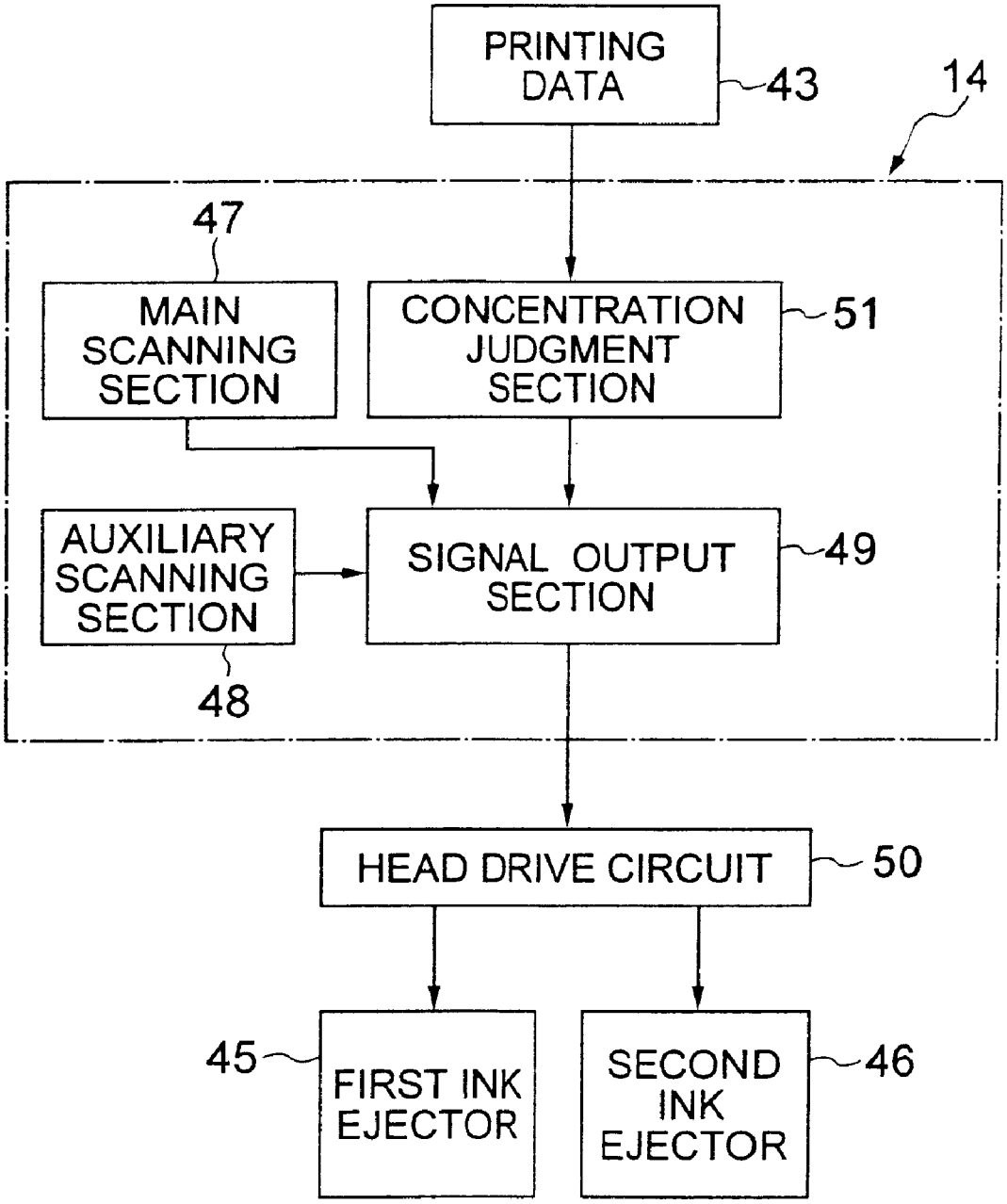
FIG. 12 is a block diagram showing a configuration of a controlling part of the inkjet printer of Embodiment 2.

A control unit 14 of an inkjet printer shown in FIG. 12 in accordance with Embodiment 2 has a density judgment section 51, a signal output section 49 and a head drive circuit 50 of which functions are different from those of the density judgment section 41, the signal output section 42 and the head drive circuit 44 in FIG. 7. Since the functions of the other elements shown in FIG. 12 are the same as those in FIG. 7, the description thereof will be omitted.

The density judgment section 51 analyzes the input printing data 43 and judges the respective printing region having different densities every stage of the printing data 43.

The signal output section 49 outputs to the head driving circuit 50, based on the judgment of the density judgment section 51, a signal prepared by selecting one or more orders of ejecting no ink droplets, ejecting a small droplet, ejecting a medium droplet and electing a large droplet to both of the first and the second ink ejectors 45 and 46.

The head driving circuit 50, in accordance with the signal from the signal output section 49, individually or simultaneously drives the first ink ejector 45 and the second ink ejector 46 to conduct the printing by means of the individually ejected or the superimposed small droplets, medium droplets and large droplets of the normal ink and the light ink to provide the corresponding gray scales on the respective printing regions judged by the density judgment section 51. The signal output section 49 and the head driving circuit 50 constitute a print control section.

TABLE 8

| Input Gray Scale Level | Light Ink | Normal Ink |
|---|---|---|
| 0 | none | none |
| 1 | small | none |
| 2 | medium | none |
| 3 | large | none |
| 4 | none | small |
| 5 | small | small |
| 6 | medium | small |
| 7 | large | small |
| 8 | none | medium |
| 9 | small | medium |
| 10 | medium | medium |

TABLE 8-continued

| Input Gray Scale Level | Light Ink | Normal Ink |
|---|---|---|
| 11 | large | medium |
| 12 | none | large |
| 13 | small | large |
| 14 | medium | large |
| 15 | large | large |

Combinations of the inputs are illustrated in Table 8 in which "Small" means a small droplet, "medium" means a medium droplet, "large" means a large droplet and "none" means that none of the small droplet, the medium droplet and the large droplet are ejected.

Printing will be described in which the standard resolution is 600 dpi (0.042 mm=25.4 mm/600), a dot area rate of the large droplet is 1, that of the medium droplet is 0.73 and that of the small droplet is 0.48. The dot sizes in this case are as shown in Table 9.

TABLE 9

| | Dot Area Rate | Dot Size ($\mu$m) |
|---|---|---|
| Small Droplet | 0.48 | 33 |
| Medium Droplet | 0.73 | 41 |
| Large Droplet | 1 | 48 |

TABLE 10

| Input Gray Scale Level | Light Ink | Normal Ink |
|---|---|---|
| 0 | none | none |
| 2.5 | small | none |
| 5 | medium | none |
| 7.5 | large | none |
| 10 | none | small |
| 12.5 | none | medium |
| 15 | none | large |

For comparison, the combinations of the input gray scale levels in case of no superimposing are illustrated in Table 10.

The present inventor has conducted experiments in which a plurality of dots have different ink densities and sizes to find out the following.

When the light ink and the normal ink are employed, a density different from those of the both inks can be obtained by means of the superimposing of the both inks. In other words, the number of gray scales can be increased to obtain high quality pictures by means of the superimposing.

When a dot is superimposed with another dot, the following three cases may occur.

(A) The respective sizes are scarcely changed.

(B) The density of the superimposed portion becomes that obtained by adding the respective dye densities (OD value).

When a relation between a dye density "x" (either of a relative value or an absolute value can be employed pro vided that the other is not employed) and a density η (OD value) is defined in an equation (1), a density η3 (OD value) at a portion of superimposed dots having a first dye density x1 and a second dye density x2 is expressed in an equation (2).

$$\eta=f(x) \quad (1)$$

$$\eta'=f(x1+x2) \quad (2)$$

(C) A density of a specified range is proportional to a dot area therein.

An area rate is defined as a ratio of a dot area to square of a dot pitch "p" (lattice area). When a first dot having an area of A1 and a density η1 (OD value) and a second dot having an area rate of A2 and a density η2 (OD value) are superimposed, the following relations can be obtained.

$$x1=f^{-1}(\eta 1) \quad (3)$$

$$x2=f^{-1}(\eta 2) \quad (4)$$

$$\eta 3=f(x1+x2) \quad (5)$$

The lattice density "η" of the superimposed portion is $$\eta=(A1-A2)*\eta 1+A2*\eta 3 \quad (6)$$

(a) when A1>A2 and the dot of A2 is contained in the dot of A1.

$$\eta=(A2-A1)*\eta 2|A1*\eta 3 \quad (7)$$

(b) when A1<A2 and the dot of A1 is contained in the dot A2.

$$\eta=A2*\eta 3 \quad (8)$$

(c) when A1=A2 and the dots of A1 and A2 are completely superimposed with each other.

The density in connection with the ink and the recording paper is expressed in an equation (9).

$$\eta=\mathrm{Log}_{10}(15.5*x2+8.3*x1) \quad (9)$$

Figure 13:
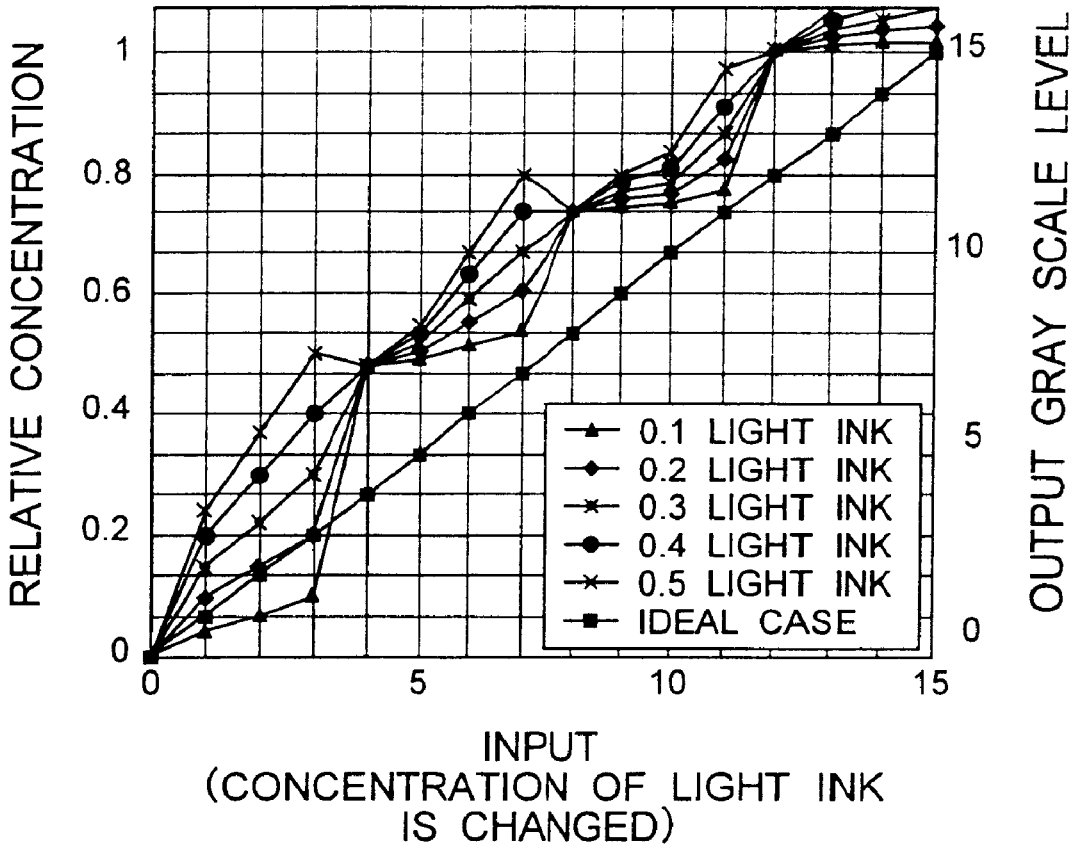
FIG. 13 is a graph showing data when the density of the light ink is changed.

Relations of relative densities to inputs when the densities of the light range between 0.2 and 0.4 are shown in a graph of FIG. 13. As shown therein, when the light ink density is between 0.2 and 0.4, relatively good linearity can be obtained to increase the number of the gray scales. Accordingly, the light ink density preferably ranges between 0.2 and 0.4.

Moreover, among 16 gray scale levels, an 11 scale level can be obtained by superimposing a light ink dot having an OD relative value of 0.3 to 0.4 with a normal ink dot having an OD relative value 1 to obtain a picture quality having higher precision compared with no superimposing (7-value). At least a level of 11-values can be obtained between 0 and 1 by the relative densities of the light ink dots and the normal ink dots. Accordingly, the light ink density more preferably ranges between 0.3 and 0.4.

Evaluation of another recording paper and ink is also conducted to obtain the following equation (10) in place of the equation (1), and an 11 level gray scale is obtained similar to Embodiment 1.

$$\eta=\mathrm{Log}_{10}(4.31*x2+11.9*x1) \quad (10)$$

In the present Embodiment, in order to output, for example, the 256 level gray scale when the 11 level gray scale is obtained, a matrix of 5×5 which is calculated by the following equation is sufficient for obtaining pictures of higher precision compared with Embodiment 1.

$$<256/(11-1)>^{1/2}-(25.6)^{1/2}\approx 5.1$$

The amount of information reaches to 600 dots×800 dots×3×11-value/256=61.875 kB which is 2.75 times that of the third conventional example to provide high precision pictures.

Figure 14:
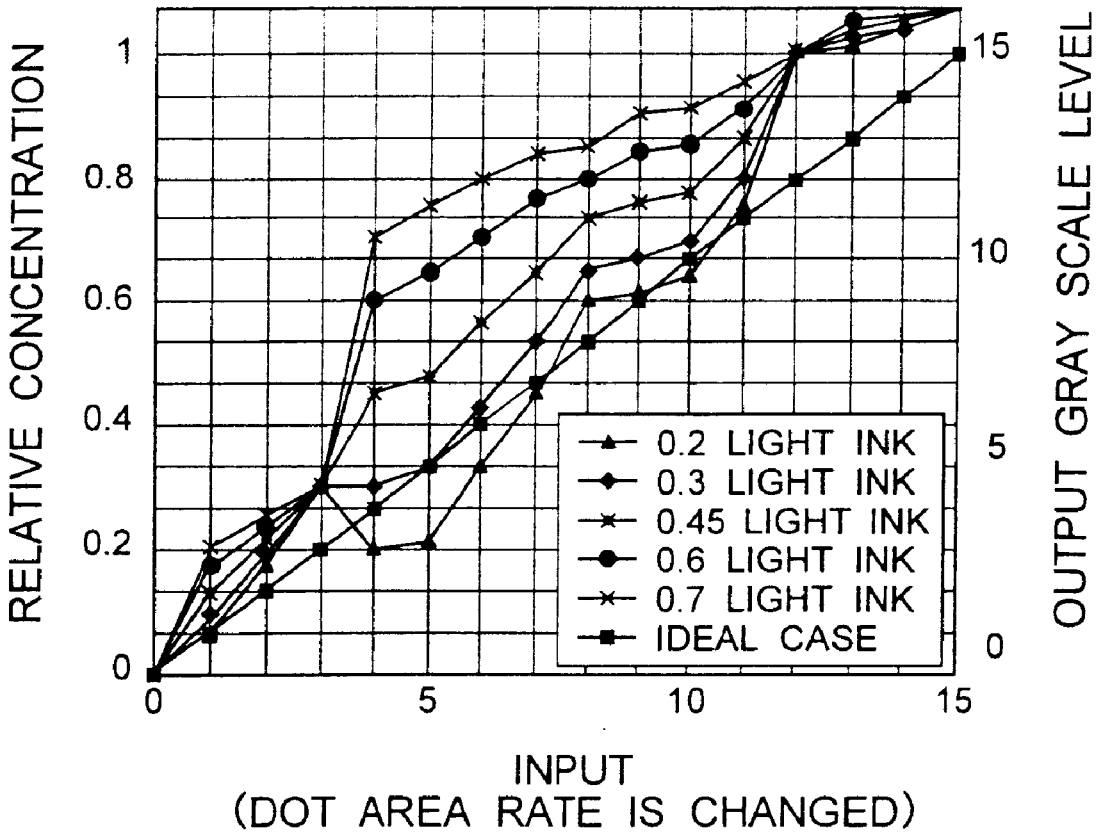
FIG. 14 is a graph showing data when the dot area rate is changed.

A relation of the relative density to the input is shown in a graph of FIG. 14 when the dot area rate of the droplet is changed between 0.2 and 0.7. The relative density of the light ink is made to be 0.3, and the dot area rate of the medium droplet is made to be an average value obtained from the dot area rates of the small droplet and the large droplet.

As shown in FIG. 14, when the dot area rate is between 0.3 and 0.6, relatively good linearity can be obtained to increase the number of the gray scales. Accordingly, the dot area rate preferably ranges between 0.3 and 0.6.

Since the above embodiments are described only for examples, the present invention is not limited to the above embodiments and various modifications or alternations can be easily made therefrom by those skilled in the art without departing from the scope of the present invention.

What is claimed is:

1. An inkjet printer comprising:

a first ink ejector capable of ejecting ink droplets having a normal density to print dots having one of a plurality of different sizes;

a second ink ejector capable of ejecting ink droplets having a light density lower than the density of the normal ink to print dots of one of a plurality of different sizes;

a density judgment section for analyzing input printing data to judge whether a region to be printed has a first density or a second density;

a print control section that operates the first ink ejector when the density judgment section judges that a region to be printed has the first density and operates the second ink ejector when the density judgment section judges that a region to be printed has the second density, the density of the light ink relative to the normal ink being between about 0.2 and about 0.5.

2. The inkjet printer as defined in claim 1 in which the density of the light ink relative to the normal ink is between 0.2 and 0.4.

3. A inkjet printer comprising:

a first ink ejector capable of ejecting normal ink droplets having a first density to print dots of one a plurality of different sizes;

a second ink ejector capable of ejecting light ink droplets having a second density lower than the density of the normal ink to print dots of one of a plurality of different sizes;

a density judgment section for analyzing input printing data to specify a gray scale level in a region to be printed in which densities in the input printing data corresponding to the regions to be printed are different from one another; and a print control section for operating the first and second ink ejectors individually or simultaneously, based on the gray scale level specified by the density judgment section, the density of the light ink relative to the normal ink being between 0.2 and 0.5.

4. The inkjet printer as defined in claim 3, in which the density of the light ink relative to the normal ink is between 0.2 and 0.4.

5. An inkjet printer comprising:

a first ink ejector capable of ejecting normal ink droplets having a first density to print dots of one of a plurality of different areas;

a second ink ejector capable of ejecting light ink droplets having a second density lower than the density of the normal ink to print dots of one of a plurality of different areas;

a density judgment section for analyzing input printing data to specify a gray scale level in a region to be printed in which densities in the input printing data corresponding to the regions to be printed are different from one another; and a print control section for operating the first and second ink ejectors individually or simultaneously, based on the gray scale level specified by the density judgment section, the area ratio of the smallest of the plurality of printed dots to the largest of the printed dots being between 0.4 and 0.6.

6. An inkjet printer comprising:

a first ink ejector capable of ejecting ink droplets having a normal density to print dots of one of a plurality of different sizes;

a second ink ejector capable of ejecting ink droplets having a light density lower than the density of the normal ink to print dots of one of a plurality of different sizes;

a density judgment section for analyzing input printing data to judge whether a region to be printed has a first density or a second density;

a print control section that operates the first ink ejector when the density judgment section judges that the region to be printed has the first density and operates the second ink ejector when the density judgment section judges that the region to be printed has the second density, the sizes of the dots being such that the printed dot area rate between 0.3 and 0.6.

7. An inkjet printer comprising:

a first ink ejector capable of ejecting normal ink droplets having a first density to form printed dots of a plurality of different sizes;

a second ink ejector capable of ejecting light ink droplets having a second density lower than the density of the normal ink to print dots of a plurality of different sizes;

a density judgment section for analyzing input printing data to specify a gray scale level in a region to be printed in which densities in the input printing data corresponding to the regions to be printed are different from one another; and a print control section for driving the first and second ink ejectors individually or simultaneously, based on the gray scale level specified by the density judgment section, the sizes of the dots being such that the printed dot area rate is between 0.3 and 0.6.

8. A printing method for an inkjet printer comprising:

analyzing input data representing a region to be printed to judge whether a region to be printed has a first density or a lower second density; and printing a region with normal ink when the corresponding input data has the first density or with a light ink having a density lower than that of the normal ink when the corresponding input data has the second density, the density of the light ink relative to the normal ink being between 0.2 and 0.5.

9. The method as defined in claim 8, in which the density of the light ink relative to the normal ink is between 0.2 and 0.4.

10. A printing method for an inkjet printer comprising:

performing an analysis of input data representing regions to be printed to determine a required density for each region; and printing a particular region using droplets of a normal ink having a first density which will produce printed dots of one of a plurality of different sizes or using droplets of a light ink having a second density lower than that of the normal ink, which will produce printed dots of one of a plurality of different sizes, the normal ink and the light ink being used together or individually in accordance with the analysis of the input data, the dot sizes being such that the dot area rate is between 0.3 and 0.6.

11. A printing method for an inkjet printer comprising:

performing an analysis of input data representing regions to be printed to determine a required density for each region; and printing a particular region using droplets of a normal ink having a first density which will produce printed dots of one of a plurality of different areas or using droplets of a light ink having a second density lower than that of the normal ink, which will produce printed dots of one of a plurality of different areas, the normal ink and the light ink being used together or individually in accordance with the analysis of the input data, the density of the light ink relative to the normal ink being between 0.2 and 0.5.

12. The method as defined in claim 11, in which the density of the light ink relative to the normal ink is between 0.2 and 0.4.

13. An inkjet printer comprising:

a first ink ejector capable of ejecting ink droplets having a normal density to print dots of one of a plurality of different areas;

a second ink ejector capable of ejecting ink droplets having a light density lower than the density of the normal ink to print dots of a plurality to different areas;

a density judgment section for analyzing input printing data to judge whether a region to be printed has a first density or a second density;

a print control section that operates the first ink ejector when the density judgment section judges that a region to be printed has the first density and operates the second ink ejector when the density judgment section judges that a region to be printed has the second density, the area ration of the smallest of the printed dots to the largest of the printed dots being between 0.4 and 0.6.

14. A printing method for an inkjet printer comprising:

analyzing input data representing a region to be printed to judge whether a region to be printed has a first density or a lower second density; and printing a region with normal ink when the corresponding input data has the first density or with a light ink having a density lower than that of the normal ink when the corresponding input data has the second density, the area ratio of the smallest of the printed dots to the largest of the printed dots being between 0.4 and 0.6.

15. A printing method for an inkjet printer comprising:

performing an analysis of input data representing regions to be printed to determine a required density for each region; and printing a particular region using droplets of a normal ink having a first density which will produce printed dots of one of a plurality of different sizes or using droplets of a light ink having a second density lower than that of the normal ink, which will produce printed dots of one of a plurality of different sizes, the normal ink and the light ink being used together or individually in accordance with the analysis of the input data, the area ratio of the smallest of the printed dots to the largest of the printed dots being between 0.4 and 0.6.

* * * * *